US006553747B1

(12) United States Patent
Texel

(10) Patent No.: US 6,553,747 B1
(45) Date of Patent: Apr. 29, 2003

(54) COMBINED HACKAMORE BRIDLE AND BIT ASSEMBLY FOR A HORSE

(75) Inventor: Raymond Warren Texel, Simi Valley, CA (US)

(73) Assignee: Beverly Hills Equestrian Partners, LLC, Simi Valley, CA (US)

( * ) Notice: Subject to any disclaimer, the term of this patent is extended or adjusted under 35 U.S.C. 154(b) by 0 days.

(21) Appl. No.: 10/139,335

(22) Filed: May 7, 2002

(51) Int. Cl.[7] ..... B68B 1/04; B68B 1/06
(52) U.S. Cl. ..... 54/6.1; 54/7
(58) Field of Search ..... 54/6.1, 6.2, 7–9, 54/16; D30/136

(56) References Cited

U.S. PATENT DOCUMENTS

| | | | | |
|---|---|---|---|---|
| 2,041,620 A | 5/1936 | Stephens | ..... | 54/6 |
| 2,186,350 A | 1/1940 | Simon | ..... | 54/6 |
| 2,342,449 A | 2/1944 | Burgess | ..... | 54/6 |
| 2,597,736 A | 5/1952 | Jones | ..... | 54/6 |
| 2,804,740 A | 9/1957 | Newman | ..... | 54/6 |
| 3,318,069 A | 5/1967 | Cunard | ..... | 54/6 |
| 3,837,142 A | 9/1974 | Hill | ..... | 54/6 |
| 4,132,054 A | 1/1979 | Mader | ..... | 54/6 |
| 4,798,043 A | 1/1989 | Wyse | ..... | 54/6 |

*Primary Examiner*—Charles T. Jordan
*Assistant Examiner*—Tara M Golba
(74) *Attorney, Agent, or Firm*—Bacon & Thomas

(57) ABSTRACT

A combined hackamore bridle and bit assembly for a horse has an improved arrangement of straps and pivoting hinge connections between various elements of the hackamore. Pivot pins are provided for pivotally securing the nose band to the rein levers. In addition, a chin engaging curb or chin chain is pivotally secured to the rein levers. A bit is provided which is attached to left and right bit rings. A cheek strap is attached to each bit ring and a cheek strap is attached to each pivot pin. Connecting straps are provided between the bit rings and the ends of the rein levers and a rein is attached to the connecting straps so that pulling the rein causes the connecting straps to simultaneously pull the bit rings and the rein levers.

8 Claims, 4 Drawing Sheets

COMBINED HACKAMORE BRIDLE AND BIT ASSEMBLY FOR A HORSE

BACKGROUND OF THE INVENTION

1. Field of the Invention

The present invention pertains to the field of horse bridles in general and more particularly to an improved hackamore bridle and bit assembly.

2. Background Information

A bitless bridle is generally known in the art as a hackamore bridle. Various types of hackamore bridles are known to those skilled in the art. For example, U.S. Pat. No. 2,804,740 describes a hackamore bridle as a bitless bridle. It is therefore said that a common feature of hackamore bridles is the elimination of the conventional bit or curb extending through the horse's mouth. Conventionally the hackamore includes a leverage assembly which typically includes a pair of rein levers, a nose band and a chin chain or strap which is sometimes referred to as a curb. Typically hackamore bridles are of the leverage type since these are considered to be the most effective. In leverage type hackamore bridles, a tightening between the nose band and the chin engaging curb is produced by leverage action. Such hackamore bridles are described in U.S. Pat. Nos. 2,804,740; 4,132,054; 2,597,736; 4,798,043; 2,041,620 and 2,186,350, the specifications of which are incorporated herein by reference. The leverage action is produced by pulling a pair of rein levers. The pulling of the rein levers is accomplished by a rein which is attached to the lower terminal portion of the rein levers.

The hackamore is attached to the horse's head by a system of straps conventionally known as a headstall, sometimes referred to as a bridle. The headstall conventionally includes a cheek strap mounted on either side of the horse's head, a brow band, a crown piece and a throatlatch.

It is known to combine a bit with a hackamore. Such combined hackamore and bit assemblies are disclosed in U.S. Pat. Nos. 3,318,069; 3,837,142 and 2,342,449. However, the combination of the hackamore and bit of the prior art devices does not provide a rider with the best amount of leverage against the horse's head and nose while providing the added control of having a bit in the horse's mouth.

SUMMARY OF THE INVENTION

It is an objective of the present invention to provide an improved hackamore bridle and bit assembly which provides the rider with improved leverage against the horse's head and nose while providing the added control of having a bit in the horse's mouth.

It is also an objective of the present invention to provide a combined hackamore and bit assembly wherein various components thereof are allowed to move individually through a system of hinges or pivots. These hinges or pivots provide a more precise movement of the hackamore and contribute to the overall advantage of the present invention compared to hackamore and bit assemblies of the prior art.

The combined hackamore bridle and bit assembly of the present invention includes a nose band having one end secured to a pivot of a left rein lever and another end secured to a pivot of a right rein lever so that the rein levers are connected to each other by a pivotable nose band which is pivotally secured to the left and right rein levers. Each rein lever includes two ends with a pivot portion located there between. The pivot portion is located along the length of the rein levers to thereby define a long arm and a short arm extending from the pivot portion. A pivot pin with a ring attached thereto extends through an opening of each pivot portion and is rotatably secured through the opening to define the pivot to which the ends of the nose band are attached.

A chin engaging curb is pivotally secured to a ring located at the end of the short arm of each rein lever. Thus the left and right rein levers are also connected together by a pivotable chin engaging curb which is pivotable independently from the pivotable nose band. The chin engaging curb is typically a chain or a strap.

A bit ring is provided on either side of the horse's head in the vicinity of the horse's mouth. One end of a bit is attached to one bit ring and the other end of the bit is attached to the other bit ring so that the bit may extend through the horse's mouth in the usual manner.

A pair of cheek straps is provided for each side of the horse's head. A cheek strap is attached to each of the two bit rings and another cheek strap is attached to each of the two rings of the pivot pins. The cheek straps attached to each of the two rings of the pivot pins lie above the cheek straps which are attached to the bit rings. Thus, on one side of the horse's head are a pair of cheek straps; one of which is attached to a bit ring on the same side of the horse's head and another of which is attached to the ring of a pivot pin on the same side of the horse's head. The same arrangement is provided for the other side of the horse's head.

The long arm of each rein lever terminates with a ring. A left connecting strap connects the ring of the left long arm with the left bit ring so that the left bit ring is-held in place only by the bit, one of the cheek straps (i.e., the lower cheek strap) and the connecting strap. The same arrangement is provided on the right side where a right connecting strap connects the ring of the right long arm with the right bit ring. Conventional reins are attached to the connecting straps.

An alignment bar is provided for maintaining the rein levers in alignment alongside the left and right sides of the horse's head. The alignment bar is connected at one end to the ring of one long arm and at the other end to the ring of the other long arm.

A headstall, which includes the pair of cheek straps on either side thereof, is provided for attaching the combined hackamore bridle and bit assembly to the horse's head.

BRIEF DESCRIPTION OF THE DRAWINGS

FIG. 6 is a perspective view which shows the nose band secured to pivot pins which are rotatably secured to each rein lever according to one embodiment of the invention.

DETAILED DESCRIPTION OF THE INVENTION AND PREFERRED EMBODIMENTS

The details of the present invention as well as a preferred embodiment thereof is described below with reference to the accompanying drawings wherein like numerals designate similar parts throughout the several views.

Figure 3:
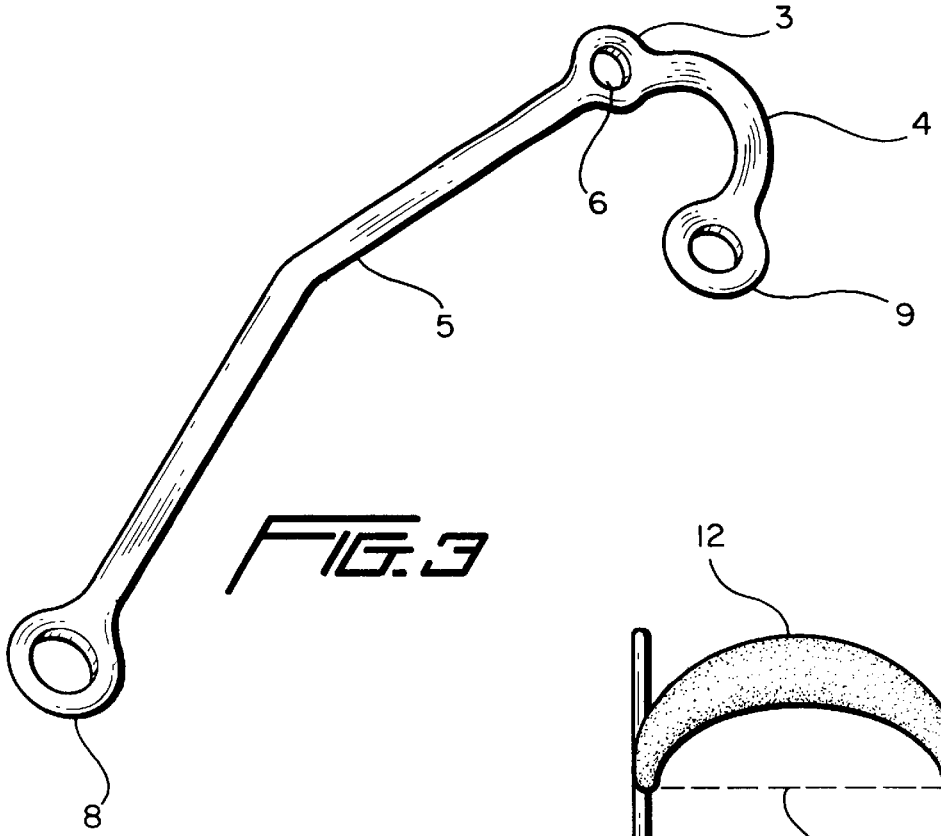
FIG. 3 is a perspective view of a rein lever used in the combined hackamore bridle and bit assembly of the invention.

A left rein lever 1 and a right rein lever 2 are provided alongside the left and right sides of a horse's head. Each of the rein levers have a pivot portion 3 with a short arm 4 and a long arm 5 extending therefrom. The pivot portion of the left and right rein levers includes an opening 6 illustrated in FIG. 3. Opening 6 is configured for securing a pivot pin therein. The long arm of the left and right rein levers terminates with a terminal ring 8 at an end remote from the pivot portion. Similarly, the short arm of the left and right rein levers terminates with a terminal ring 9 at the end remote from the pivot portion.

A pivot pin 7 is rotatably secured through the opening 6 of each rein lever so that pin 7 is secured while being free to rotate within the opening. Thus, a left pivot pin is rotatably secured through the opening of the left rein lever and a right pivot pin is rotatably secured through the opening of the right rein lever whereby the left and right pivot pins extend through the openings of the left and right rein levers respectively and thereby define a pivot on each rein lever.

A ring is connected to each of the pivot pins. Thus a left pivot ring 10 is connected to the pivot pin 7 which is secured to the left rein lever (i.e., left pivot 10 ring is secured to a left pivot pin. A right pivot ring 11 is connected to the pivot pin 7 which is attached to the right rein lever (i.e., right pivot ring 11 is connected to a left pivot pin 7). Pivot rings 10 and 11 are preferably attached to their respective pivot pins by passing through an aperture 60 located on each pivot pin.

Figure 5:
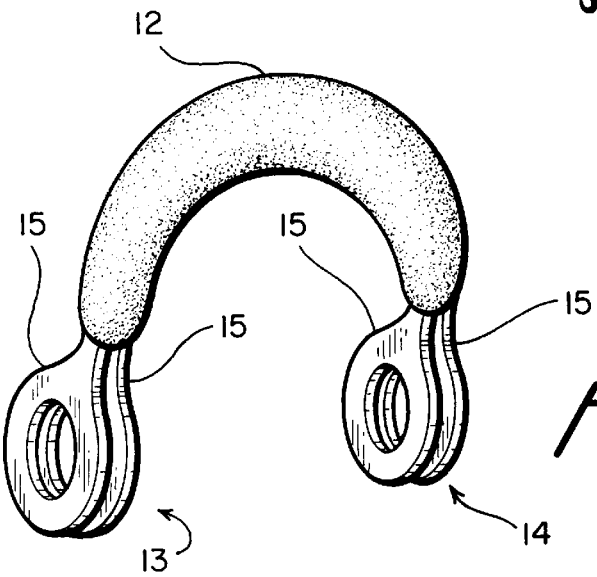
FIG. 5 is a perspective view of a nose band according to one embodiment of the invention.

A nose band 12 has first and second ends 13 and 14 respectively as shown in FIG. 5. Each of the ends of the nose band is configured for rotation around the pivot pins. Preferably each end of the nose band includes a pair of ring connectors shown by reference numeral 15 in FIG. 5. Thus, the first end of the nose band is secured to the left pivot pin by the passage of the left pivot pin through the opening 6 of the left rein lever and through the pair of ring connectors located at end 13 of the nose band. A similar arrangement is found on the right side of the nose band. Thus, a nose band is provided having first and second ends wherein the first end is secured to the left pivot pin and the second end is secured to the right pivot pin whereby the nose band is pivotally secured to the left and right rein levers.

A left bit ring 16 and a right bit ring 17 are provided for securing of a bit thereto. Preferably bit 18 is secured to bit rings 16 and 17 by means of apertures 21 and 22 located at left and right ends 19 and 20 respectively of bit 18. More particularly, in a preferred embodiment, left bit ring 17 is attached to left end 19 of bit 18 by passage of bit ring 16 through aperture 21 of bit 18. Similarly right bit ring 17 is secured to right end 20 of bit 18 by passage of right bit ring 17 through aperture 22 located at end 20 of bit 18. In a preferred embodiment bit 18 includes a left bit component 23 and a right bit component 24 which are connected to each other in a middle portion of the bit by two interlocking rings 25 and 26. Interlocking rings 25 and 26 form a coupling which permits movement of components 23 and 24 such that bit 18 is a nonrigid or flexible structure.

Left bit ring 16 is connected to ring 8 of the long arm of the left rein lever by left connecting strap 27. Similarly right bit ring 17 is connected to ring 8 of the long arm of the right rein lever by connecting strap 28.

One end of a conventional rein 48 is connected to left connecting strap 27 and the other end of the rein is connected to right connecting strap 28.

Figure 9:
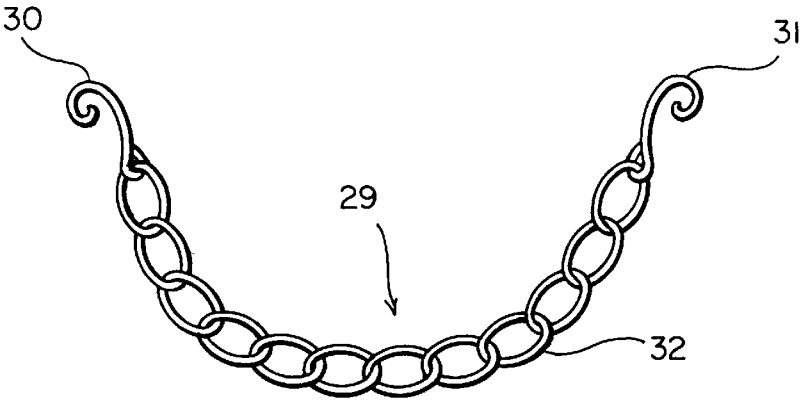
FIG. 9 is a perspective view of chin engaging curb used in the invention.
Figure 10:
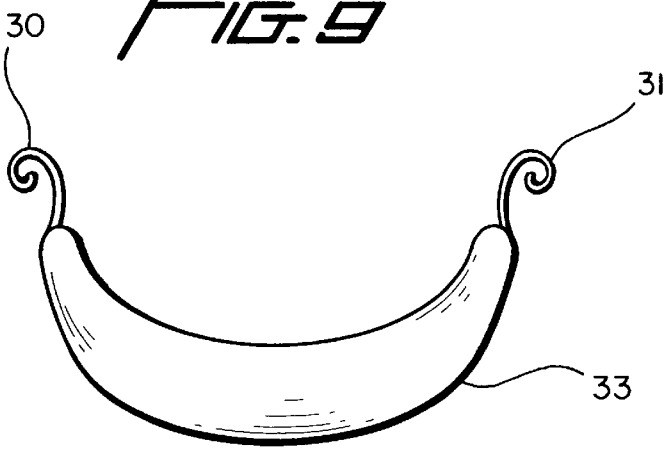
FIG. 10 is a perspective view of the chin engaging curb of FIG. 9 wherein the chain is covered with a sheath.
Figure 8:
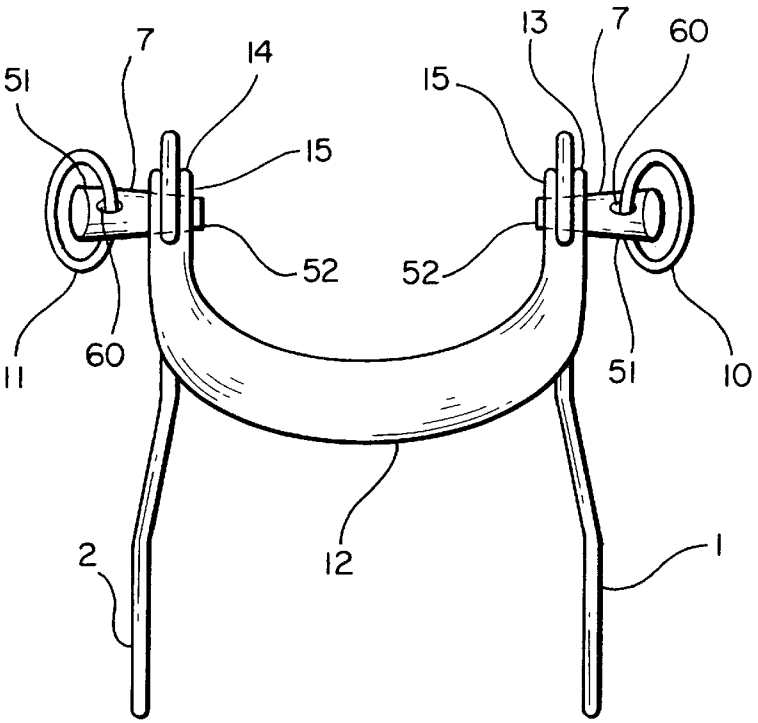

A chin engaging curb 29 is provided for engaging the chin of the horse's head. The chin engaging curb has a left end 30 and a right end 31 as shown in FIG. 9. In a preferred embodiment chin engaging curb 29 is made from interlocked chain links wherein one of the chain links is indicated by reference numeral 32 in FIG. 9. In an alternative embodiment the chin engaging curb may be a strap or similar flexible structure. In another preferred embodiment the chin engaging curb is covered with a sheath 33 so that the chain links of the chin engaging curb are not exposed and thus do not injure the horse's chin when tightly engaged therewith such as would occur when the reins are pulled.

The left end 30 of the chin engaging curb is pivotally secured to ring 9 of the short arm 4 of left rein lever 1 and the right end 31 of the chin engaging curb is pivotally secured to ring 9 of short arm 4 of right rein lever 2.

In a preferred embodiment the left and right ends 30 and 31 of the chin engaging curb are in the form of hooks as illustrated in FIG. 9. The hook of left end 30 is preferably pivotally secured to ring 9 of the short arm 4 of the left rein lever. Likewise the hook of end 31 of the chin engaging curb is pivotally secured to ring 9 of the short arm 4 of the right rein lever 2.

Figure 7:
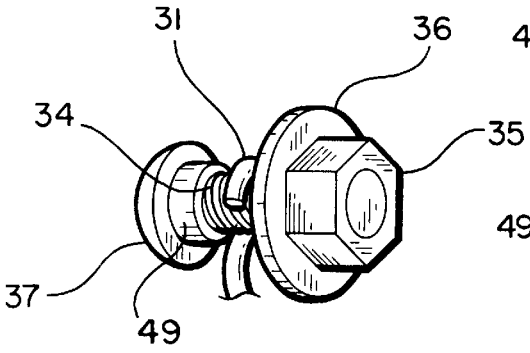
FIG. 7 is a perspective view of a pivotable connecting piece which is used to pivotally secure the chin strap or chain to the rein lever according to one embodiment of the invention.

The hooks of the chin engaging curb are preferably pivotally attached to the short arms of the left and right rein levers by means of a bolt 34 which extends through each ring 9 of the short arms of the left and right rein levers. The hook on the end of the chin engaging curb is placed around the bolt so that the hook with the chin engaging curb attached thereto is able to pivot as the bolt rotates within ring 9. An example of such an attachment is shown in FIG. 7 where the hook of right end 31 of the chin engaging curb extends around bolt 34. Also shown in FIG. 7 is a nut 35 and washer 36 attached to the threaded end of bolt 34.

Bolt 34 preferably includes a rounded head 37. In a preferred embodiment the bolt 34 passes through ring 9 in a direction so that head 37 is next to the cheek area of the horse while nut 35 extends outward away from the horse's cheek area.

Figure 8:
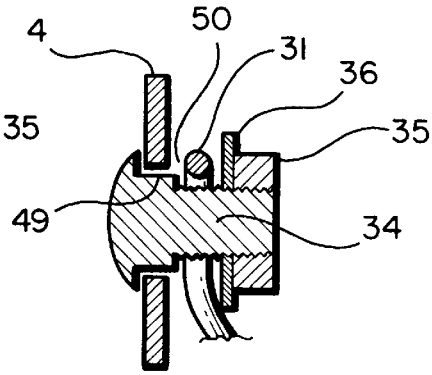
FIG. 8 is a cross-sectional view of one end of the chin strap or chain pivotally secured to the rein levers according to one embodiment of the invention.

FIG. 8 illustrates the hook of end 31 pivotally secured to short arm 4 by means of the bolt 34, washer 36 and nut 35. When making the attachment nut 35 is tightened around the threaded portion of bolt 34.

In a preferred embodiment head 37 of bolt 34 includes a generally cylindrical extension 49 shown in FIGS. 7 and 8. Extension 49 has a diameter slightly less than the inside diameter of ring 9 through which bolt 34 passes. In addition, extension 49 has a length which is slightly longer than the passageway defined by ring 9. Consequently, when bolt 34 is inserted into ring 9, extension 49 permits the hook of end 31 to be tightly engaged therewith by the tightening of nut 35 without impeding the ability of bolt 34 to rotate within ring 9. In other words the geometry of extension 49 relative to the passageway within ring 9 is such that the hook of end 31 is tightened against extension 49 while leaving a small gap 50 between short arm 4 of the rein lever and the hook of end 31. Alternatively, if there is no gap, the hook of end 31 does not press against the rein lever to such an extent which would prevent bolt 34 from rotating within ring 9. This gap or avoidance of excessive pressing against the rein lever together with the smaller diameter of extension 49 relative to the inside diameter of ring 9 allows bolt 34 to rotate freely within ring 9 even when nut 35 is fully tightened to press washer 35 firmly against hook end 31. Consequently, the chin engaging curb is pivotally secured to rings 9 of the short arms 4 of the left and right rein levers.

Figure 1:
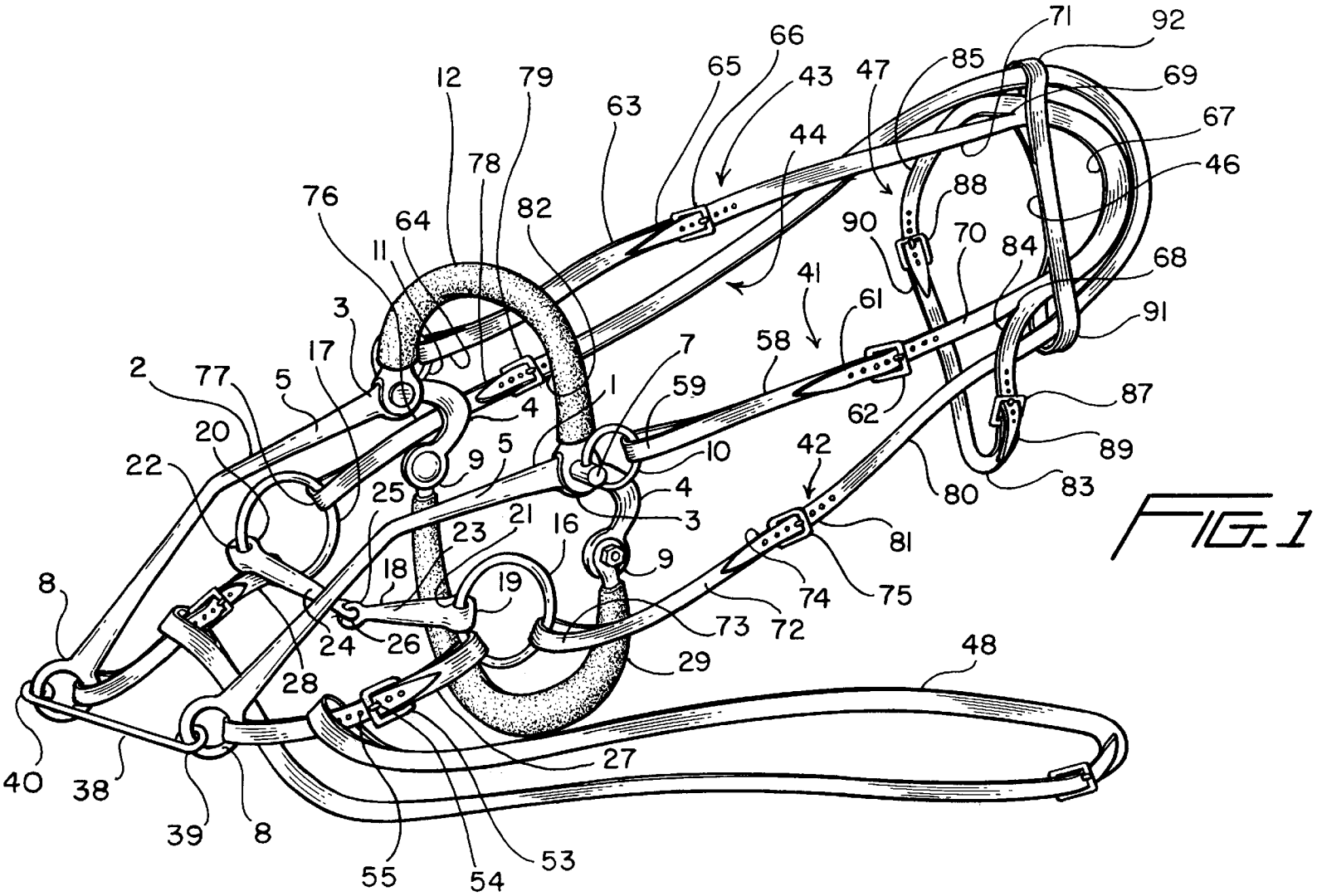
FIG. 1 is a perspective view of the combined hackamore bridle and bit assembly according to one embodiment of the invention.

An alignment bar 38 is attached to rings 8 of rein levers 1 and 2 for maintaining the rein levers in alignment alongside the left and right sides of the horse's head. A conventional alignment bar may be used for this purpose. As shown in FIG. 1, the alignment bar has a left end 39 and a right end 40 which are bent around rings 8 for attachment thereto.

A headstall is provided for attaching the hackamore bridle and bit assembly to the horse's head. The headstall includes adjustable length cheek straps attached to the left and right bit rings and left and right pivot rings. Thus, on the left side of the horse's head there is an upper cheek strap shown generally by reference numeral 41 which is attached to left pivot ring 10 and a lower cheek strap shown generally by reference numeral 42 attached to left bit ring 16. On the right side of the horse's head there is an upper cheek strap shown generally by reference numeral 43 which is attached to right pivot ring 11 and a lower cheek strap shown generally by reference numeral 44 which is attached to the right bit ring 17.

Figure 2:
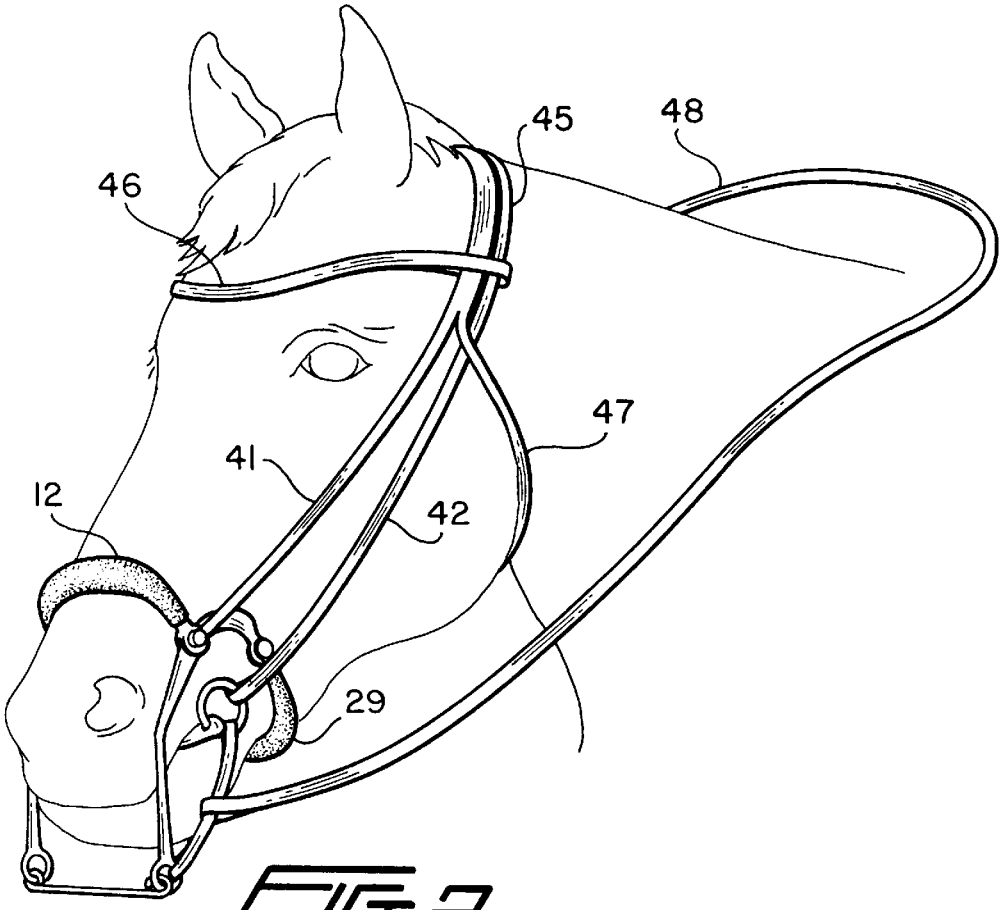
FIG. 2 is a perspective view of the combined hackamore bridle and bit assembly of FIG. 1 shown as it is typically positioned on a horse's head.

The headstall is configured to hold the combined hackamore bridle and bit assembly on the horse's head. Accordingly, in addition to the above-mentioned cheek straps, the headstall may include further straps such as a crown piece 45 which passes over the horse's head behind the horse's ears; a brow band 46 which passes in the horse's brow area in front of the ears; and a throat latch 47 which passes underneath the horse's head in the vicinity of the horse's throat. The above-mentioned positioning of the brow band 46 crown piece 45 and throat latch 47 are shown in FIG. 2.

The sheath 33 of the chin engaging curb may be made from any flexible material such as leather, plastic, fabric and the like to provide the horse with appropriate protection from the chain links.

The pivot pins 7 preferably have an outer end portion 51 which has a larger diameter than inner end 52. The diameter of inner end 52 is small enough to allow passage of pivot pin 7 through connecting ring 15 and opening 6 of the rein lever and to allow rotation of the pivot pin therein. After the pivot pin 7 has been inserted through connecting ring 15 and opening 6, inner end 52 may be conveniently deformed to increase its diameter so that the diameter is sufficiently large to prevent the pivot pin from being pulled out of connecting ring 15 and opening 6 through which it passes. The diameter of end portion 51 is larger than the inside diameter of connecting ring 15 so that only a portion of pivot pin 7 may extend through connecting ring 15 and opening 6. The portion which extends through connecting ring 15 and opening 6 is sufficiently long so that end portion 52 protrudes slightly as shown in FIG. 6.

Also in a preferred embodiment connecting straps 27 and 28 are of adjustable lengths. The lengths of connecting straps 27 and 28 may be adjusted by incorporating any conventional length adjusting mechanism thereto. For example, a standard belt buckle 51 may be used for this purpose. Instead of a conventional buckle, other similar devices such as clasps, buttons, hooks and the like may be used. When using a conventional buckle, a strap which passes through the buckle for attachment to a catch on the buckle, will have a plurality of apertures extending along a length thereof so that the length of the strap passing through the buckle can be selected by passing the catch of the buckle through a selected aperture in the standard manner of adjusting a belt buckle.

A conventional buckle 53 is shown as a component of connecting strap 27 in FIG. 1. Buckle 53 includes a catch 54 inserted through one of a plurality of apertures 55 which are installed along the length of the strap which passes through the buckle. Such conventional buckles are used to adjust the length of the various straps of the headstall as herein below described.

Figure 4:
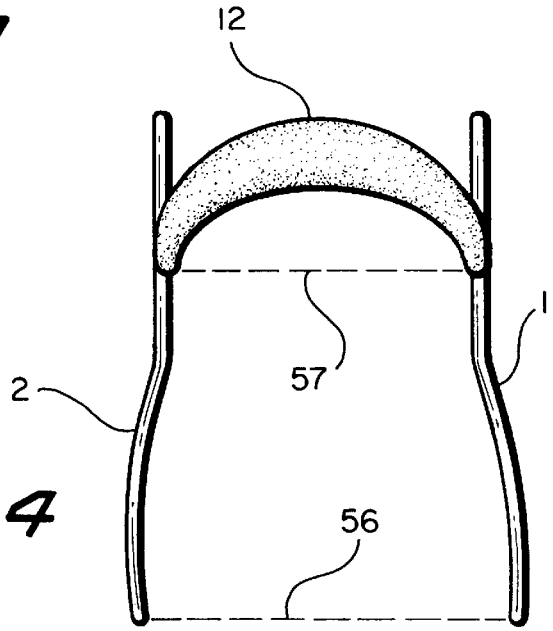
FIG. 4 is a top perspective view of a pair of rein levers connected by a nose band which illustrates the bending of the rein levers according to one embodiment of the invention.

Also, in a preferred embodiment, the rein levers are bent so that the distance between rings 8 of the left and right rein levers 1 and 2 is greater than the distance of rein levers 1 and 2 at the point where the nose band is attached to the rein levers. This embodiment of the invention is illustrated in FIG. 4 wherein the distance indicated by dashed line 56 is greater than the distance indicated by dashed line 57.

In a preferred embodiment the headstall is constructed as shown in FIG. 1. In FIG. 1 a first left strap 58 has a first end portion 59 connected to left pivot ring 10. The first left strap also has a second end portion 61 which is connected to buckle 62.

A first right strap 63 has a first end portion 64 connected to right pivot ring 11. The first right strap 63 has a second end portion 65 connected to buckle 66.

A headstall connecting strap 67 has a left bifurcated end portion 68 and a right bifurcated end portion 69. The left bifurcated end portion 68 has a first terminal strap 70 connected to the second end portion 61 of the first left strap 58 via buckle 62. A first right terminal strap 71 is connected to the second end portion 65 of the first right strap 63 via buckle 66. Thus the first left and right straps 58 and 63 in combination with the first left and first right terminal straps 70 and 71 of the headstall connecting strap 67 together with buckles 62 and 66 define adjustable length cheek straps 41 and 43 connected to left and right pivot rings 10 and 11 respectively.

Buckles 62 and 63 are conventional buckles such as buckle 53 described above. Of course, although buckle 62 and 63 have been described as being attached to end portions 61 and 65 of straps 58 and 63 respectively, it is also contemplated that these buckles could be attached to straps 70 and 71 to provide a similar method of attachment.

A second left strap 72 has a first end portion 73 attached to bit ring 16.

The second left strap 72 also has a second end portion 74 attached to buckle 75. Similarly a second right strap 76 has a first end portion 77 attached to right bit ring 17. Second right strap 76 has a second end portion 78 connected to buckle 79.

A first middle strap 80 has a left end portion 81 and a right end portion 82. Left end portion 81 is connected to the second end portion 74 of the second left strap 72 via buckle 75. Similarly the right end portion 82 of the first middle strap 80 is connected to the second end portion 78 of the second right strap 76 via buckle 79. Thus the first middle strap 80 in combination with second left strap 72 and second right strap 76 together with buckles 75 and 79 define an adjustable length cheek strap attached to the left and right bit rings. The left portion of the adjustable length cheek strap attached to the left and right bit rings forms cheek strap 42. Similarly cheek strap 44 is formed by the right portion of the adjustable length cheek strap attached to the left and right bit rings.

Bifurcated end portion 68 of headstall connecting strap 67 also includes second left terminal strap 84. Similarly the right bifurcated end portion 69 of headstall connecting strap 67 includes a second right terminal strap 85.

A second middle strap 83 has a first end portion 89 and a second end portion 90. The first end portion 89 is attached to the second left terminal strap 84 of the left bifurcated end portion 68 of headstall connecting strap 67 via buckle 87. The second end portion 90 of second middle strap 83 is attached to the second right terminal strap 85 of the right bifurcated end portion 69 of the headstall connecting strap 67 via buckle 88. Thus the second middle strap 83 in combination with the second left terminal strap 84 and the second right terminal strap 85 and buckles 87 and 88 define a throat latch 47.

A brow band 46 is provided with a left end portion 91 which is preferably in the form of a loop. The brow band also includes a right end portion 92 which is also preferably in the form of a loop. The left end portion 91 is connected to a left portion of the first middle strap 80 and a left portion of the headstall connecting strap 67. The right end portion 92 of the brow band is connected to a right portion of the first middle strap 80 and the headstall connecting strap 67. Preferably the aforementioned connections between the brow band and the first middle strap and the headstall connecting strap is formed by passing the first middle strap 80 and the headstall connecting strap 67 through the loops of the brow band as illustrated in FIG. 1. The brow band is positioned to extend across the brow area of the horse's head and thus defines a crown piece formed by the portion of the first middle strap 80 and the headstall connecting strap 67 which extends from the left and right end portions of the brow band so that the crown piece is configured to extend across the horse's head behind the brow piece and behind the ears of the horse's head as shown in FIG. 2.

The buckles which are used to attach one strap to another may be connected to either of the two straps. Thus, for example instead of attaching buckle 75 to end portion 74 of the second left strap 72, this arrangement could be reversed by attaching buckle 75 to end portion 81 of strap 80. In this reversed arrangement end portion 74 of the second left strap 72 would have a plurality of apertures so that the catch of the buckle can be inserted in any selected aperture for adjusting the length of the straps. The same applies to all of the buckles described herein.

Pulling the rein 48 causes connecting straps 27 and 28 to simultaneously pull the bit rings and the rings at the end of the long arms of each rein lever.

This causes the bit to be firmly engaged against the horse's mouth and causes the rein levers to be pulled in a downward direction and further causes the rein levers to pivot about the pivot pins 7 on each side of the hackamore. This downward pulling and pivoting causes the nose band and chin engaging curb to be pressed against the nose and chin of the horse's head respectively. Thus pressure is applied against the horse's nose and chin. In addition, the short arms of the rein levers rub against the horse's cheek.

While the present invention has been described in terms of certain preferred embodiments, one skilled in the art will readily appreciate that various modifications, changes, omissions and substitutions may be made without departing from the spirit thereof. It is intended, therefore, that the present invention be limited solely by the scope of the following claims.

I claim:

1. A combined hackamore bridle and bit assembly for a horse which comprises:

left and right rein levers for positioning alongside left and right sides of a horse's head; each of said left and right rein levers having a pivot portion with a short arm and a long arm extending therefrom wherein said pivot portion of said left and right rein levers includes an opening for the securing of a pivot pin therein; said long arm and said short arm of said left and right rein levers terminating with a terminal ring at an end remote from said pivot portion;

a left pivot pin rotatably secured through the opening of said left rein lever and a right pivot pin rotatably secured through the opening of said right rein lever whereby said left and right pivot pins extend through the openings of said left and right rein levers respectively and thereby define a pivot on each rein lever;

a left pivot ring connected to said left pivot pin and a right pivot ring connected to said right pivot pin;

a nose band having first and second ends wherein said first end is secured to said left pivot pin and said second end is secured to said right pivot pin whereby said nose band is pivotally secured to said left and right rein levers;

a left bit ring and a right bit ring;

a bit having a first end attached to said left bit ring and a second end attached to said right bit ring;

a left connecting strap which connects said left bit ring to the terminal ring of the long arm of said left rein lever and a right connecting strap which connects said right bit ring to the terminal ring of the long arm of said right rein lever;

a rein having first and second ends, said first end being connected to said left connecting strap and said right end being connected to said right connecting strap;

a chin engaging curb configured for engaging the chin of said horse's head, said chin engaging curb having a left end and a right end wherein said left end is pivotally secured to the terminal ring of the short arm of said left rein lever and said right end is pivotally secured to said terminal ring of the short arm of said right rein lever;

an alignment bar for maintaining said rein levers in alignment alongside said left and right sides of said horse's head, said alignment bar having left and right ends wherein said left end of said alignment bar is attached to the terminal ring of the long arm of said left rein lever and said right end of said alignment bar is attached to the terminal ring of the long arm of said right rein lever;

a headstall configured for attaching said hackamore bridle and said bit to said horse's head, said headstall including adjustable length cheek straps attached to said left and right bit rings and said left and right pivot rings;

a rein having a first end connected to said left connecting strap and a second end connected to said right connecting strap whereby pulling on said rein causes said rein levers to move which in turn pulls said nose band toward said nose to thereby apply pressure thereto and causes said rein levers to pivot around said pivots which thereby causes said short arms of said rein levers to rub against said horse's cheek and to pull said chin engaging curb against said chin to thereby apply pressure thereto;

and pulling said rein causes said bit rings to move said bit against the mouth of said horse.

2. The combined hackamore bridle and bit assembly of claim 1 wherein said chin engaging curb is a chain.

3. The combined hackamore bridle and bit assembly of claim 2 wherein said chain is covered with a sheath.

4. The combined hackamore bridle and bit assembly of claim 3 wherein said left and right connecting straps are adjustable length straps.

5. The combined hackamore bridle and bit assembly of claim 4 wherein said bit comprises two pieces flexibly joined to each other between said first and second ends of said bit.

6. The combined hackamore bridle and bit assembly of claim 5 wherein said headstall comprises:

a first left strap having first and second end portions thereof wherein said first end portion is connected to said left pivot ring;

a first right strap having first and second end portions thereof wherein said first end portion thereof is connected to said right pivot ring;

a headstall connecting strap having left and right bifurcated end portions whereby said left bifurcated end portion has first and second left terminal straps and said right bifurcated end portion has first and second right terminal straps; said first left terminal strap being connected to the second end portion of the first left strap by a first buckle and said first right terminal strap being connected to the second end portion of the first right strap by a second buckle whereby said first left and right straps in combination with said first left and said first right terminal straps of said headstall connecting strap and said first and second buckles define said adjustable length cheek straps connected to said left and right pivot rings respectively; said first and second buckles being configured for adjusting the length of said cheek straps connected to said left and right pivot rings;

a second left strap having first and second end portions thereof wherein said first end portion is connected to said left bit ring;

a second right strap having first and second end portions thereof wherein said first end portion thereof is connected to said right bit ring;

a first middle strap having a left end portion thereof and a right end portion thereof wherein said left end portion of said first middle strap is connected to the second end portion of said second left strap by a third buckle and said right end portion of said first middle strap is connected to the second end portion of said second right strap by a fourth buckle whereby said first middle strap in combination with said second left and right straps and said third and fourth buckles define said adjustable length cheek straps attached to said left and right bit rings; said third and fourth buckles being configured for adjusting the length of said cheek straps attached to said left and right bit rings;

a second middle strap having first and second end portions thereof wherein said first end portion thereof is attached to said second left terminal strap of said left bifurcated end portion of said headstall connecting strap by a fifth buckle and said second end portion thereof is attached to said second right terminal strap of said right bifurcated end portion of said headstall connecting strap by a sixth buckle; whereby said second middle strap in combination with said second left and right terminal straps and said fifth and sixth buckles define a throat latch; said fifth and sixth buckles being configured for adjusting the length of said throat latch;

a brow band having a left end portion and a right end portion wherein said left end portion is connected to a left portion of said first middle strap and said headstall connecting strap and said right end portion of said brow band is connected to a right portion of said first middle strap and said headstall connecting strap; said brow band being positioned to extend across a brow area of said horse's head and to define a crown piece formed by a portion of said first middle strap and said headstall connecting strap which extends from said left and right end portions of said brow band whereby said crown piece is configured to extend across said horse's head behind said brow piece and behind the ears of said horse's head.

7. The combined hackamore bridle and bit assembly of claim 1 wherein said connecting strap includes a buckle for adjusting the length of said connecting strap.

8. The combined hackamore bridle and bit assembly of claim 1 wherein said left and right rein levers are bent so that the distance between the terminal rings of said long arms of said left and right rein levers is greater than the distance of said left and right rein levers at the point where said left and right rein levers are attached to said nose band.

* * * * *